United States Patent [19]

Bargel et al.

[11] 4,159,819

[45] Jul. 3, 1979

[54] TUBE-DRIVING APPARATUS

[75] Inventors: Günther Bargel; Heinz Hüsemann, both of Werne, Fed. Rep. of Germany

[73] Assignee: Gewerkschaft Eisenhutte Westfalia, Westfalia, Fed. Rep. of Germany

[21] Appl. No.: 652,477

[22] Filed: Jan. 26, 1976

[30] Foreign Application Priority Data

Feb. 6, 1975 [DE] Fed. Rep. of Germany ..... 2504967

[51] Int. Cl.[2] ..... E21B 19/00

[52] U.S. Cl. ..... 254/29 R

[58] Field of Search ..... 254/29 R, 30, 105, 134; 61/72.7

[56] References Cited

U.S. PATENT DOCUMENTS

| | | | |
|---|---|---|---|
| 2,544,039 | 3/1951 | Pearne | 254/134 |
| 3,005,314 | 10/1961 | Cunningham | 254/29 R |
| 3,358,966 | 12/1967 | Bergstrom | 61/72.7 |
| 3,526,387 | 9/1970 | Fleming | 254/30 |
| 3,995,829 | 12/1976 | Foik | 254/29 R |
| 4,082,248 | 4/1978 | Hinrichsen | 254/29 R |

FOREIGN PATENT DOCUMENTS

| | | | |
|---|---|---|---|
| 678494 | 9/1952 | United Kingdom. | |
| 1202304 | 8/1970 | United Kingdom | 61/72.7 |
| 139276 | 3/1961 | U.S.S.R. | 254/30 |

*Primary Examiner*—Robert C. Watson

*Attorney, Agent, or Firm*—Thompson, Birch, Gauthier & Samuels

[57] ABSTRACT

A tube-driving apparatus has piston and cylinder units supported on an abutment and internally connected to cylinders forming tension members which surround the units. A thrust collar engageable with the tube or pipe to be driven is slidably supported on floor beams and has clamping rings which can be secured or released from grooves on the exterior of the cylinders spaced-apart in the direction of driving.

9 Claims, 4 Drawing Figures

TUBE-DRIVING APPARATUS

BACKGROUND OF THE INVENTION

The present invention relates to apparatus for use in driving pipes or similar tubular structures, hereinafter referred to for convenience as pipes, into the ground.

Pipe or tube-driving apparatuses are used in the formation of underground pipe lines and tunnels and are installed in an underground excavation. Normally such apparatuses employ hydraulic piston and cylinder units which act on a thrust ring or member directly engageable with the end of the pipe to be driven. Since space is usually cramped a problem frequently encountered with such apparatus is to construct the apparatus to permit the units to drive in a pipe of somewhat greater length than the stroke of the units. This then involves several strokes or operative cycles of the units. In German patent specification No. 1634377 the units of a tube-driving apparatus can be changed over to alternately exert a pushing and then a pulling force on the thrust ring. In the pulling position the units are disposed at opposite sides of the pipe and are connected to the thrust ring with rods. In German specification No. 2241685 the units and thrust member are locatable inside the pipe, thereby saving considerable space, and hook-like locating members engage on the end of the pipe to transmit the thrust force thereto. Naturally this apparatus cannot be used with pipes of small cross-section. In German specification No. 1927870 the effective length of the piston rod of the ram or unit can be extended by a part lockable in various positions.

All these known forms of apparatus are generally quite costly and relatively complex and involve certain disadvantages during operation and a general object of this invention is to provide an improved form of apparatus.

SUMMARY OF THE INVENTION

In one aspect the invention provides a tube-driving apparatus comprising collar means engageable with one end of a pipe to be driven for transmitting force thereto, at least one piston and cylinder unit for producing said force, and means for transferring tensile force between the unit and the force transmitting means, the transferring means including coupling means adapted to permit selective coupling between the force transmitting means and part of the force transferring means at positions displaced from one another in the driving direction whereby the pipe can be driven by successive operative cycles of said unit by coupling the force transmitting means to said part of the force transferring means at different positions. The units can conveniently locate on diametrically opposite sides of the collar means.

In another aspect the invention provides a tube-driving apparatus comprising means engageable with one end of a pipe to be driven for transmitting force thereto, piston and cylinder units for producing said force, tension members for conveying force between said units and the force transmitting means, each tension member at least partly surrounding one of the piston and cylinder units, and coupling means permitting selective coupling between the tension members and the force transmitting means at positions displaced in the direction of driving said pipe. Preferably the aforesaid positions are offset by the stroke of the unit or units. The units can thus be relatively short in length yet it is generally possible to drive in pipes of conventional length by two operative cycles of the units. The tension members can be conveniently in the form of cylinders each of which contains one of the piston and cylinder units and which have end walls flexibly connected to the units e.g. to the piston rods. In general, the coupling means can be in the form of a location means, such as grooves or a similar shaping on the exterior of the tension members which receive clamping devices carried by the collar. Such devices can be released or secured quite quickly and easily which is a notable advantage.

A displaceable frame which can employ floor beams on which the collar means is slidably supported and an abutment for the units is also preferably provided.

It is advantageous to pivotably connect at least one of the units to the abutment to permit the unit to swing laterally of the apparatus to thereby enable the introduction of the pipes laterally.

An apparatus made in accordance with the invention can be constructed comparatively cheaply and can be of minimal size.

The invention may be understood more readily and various other features of the invention may become more apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
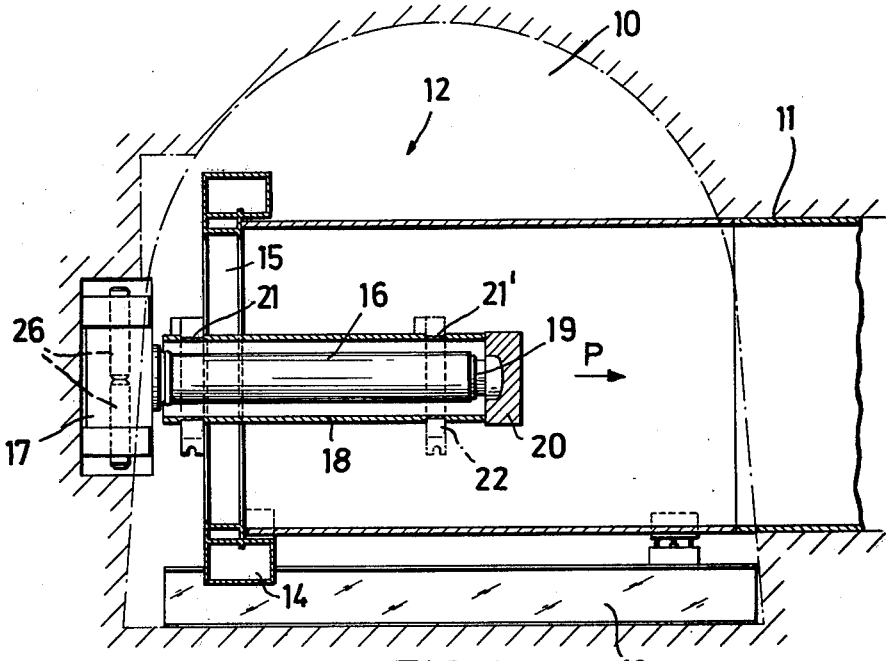
FIG. 1 is a diagrammatic part-sectional side view of one form apparatus made in accordance with the invention.

By way of illustration the apparatus shown in the drawings is depicted as being used in the preliminary construction of an underground tunnel such as an underground railway tunnel. Thus, as is known, a sidewall drift 10 is produced which extends transversally or laterally of the intended tunnel direction. The tunnel, when constructed is usually of somewhat larger cross-section than the drift 10. In order to create a support structure for the roof of the tunnel, apparatus is installed in the drift 10 to drive pipes 11, usually made from steel, into the side wall of the drift 10. The pipes 11 are pressed directly into the side wall face end-to-end and side-by-side in closely adjacent parallel relationship to form an array of ridge or domed or planar shaped roof support structure for the tunnel. Material is preferably removed from inside the pipes 11 and these are filled with concrete. Thereafter material is removed from beneath the roof structure suitably supported and a layer of concrete is applied over the bottom part of the roof structure. The apparatus, generally designated by reference numeral 12, serves to drive the pipes 11 into the side wall face although the apparatus can be used in other pipe-driving applications, for example, in forming a simple single pipe line.

Figure 2:
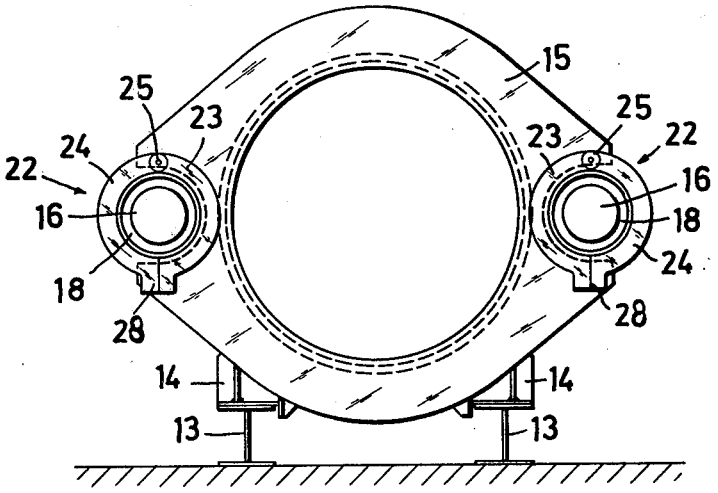
FIG. 2 is an end view of the apparatus shown in FIG. 1.

The apparatus 12 has two rigid floor beams or girders 13 which rest on the floor of the drift 10 or some other underground excavation such as a trench. These beams 13 extend parallel to one another and each beam 13 has a I-shaped cross-section as shown in FIG. 2. Preferably one or more cross-pieces (not shown) interconnect the beams 13. Means for transmitting driving force to the pipes 11 takes the form of a thrust collar or ring 15 which is supported by guide shoes 14 slidably engaging on the upper flanges of the floor beams 13. The collar 15 can be a rigid hollow, box-sectioned member.

An abutment-forming member 17 which can be a stout plate or a box-sectioned member as illustrated is intended to engage on the rear-side wall of the drift 10 or a wall of a like excavation remote from the intended direction of pipe driving denoted by arrow P. Two double-acting hydraulic piston and cylinder units or rams 16 are arranged symmetrically at opposite diametric sides of the collar 15 and are directly supported by the member 17. One of the units 16 (at the right of FIGS. 3 and 4) has its cylinder pivotably coupled to the member 17 with a hinge joint 26 so that this unit 16 can swing about a vertical axis in the direction of the arrows S in FIGS. 3 and 4. Each unit 16 extends within a tension member 18 which in this embodiment is of cylindrical shape. Each member 18 has an end wall or base 20 at its forward end and the piston rod 19 of the associated unit 16 is pivotably or flexibly connected to this wall 20.

Means are provided for selectively coupling the members 18 to the collar 15 in different operating positions. In this construction, the members 18 each have axially-offset grooves 21, 21' on its outer periphery forming a means for locating clamping devices 22 on the collar 15. These grooves 21, 21' are preferably spaced-apart by a distance substantially equal to the stroke of the units 16. The clamping devices 22 are arranged on the diametrically opposite sides of the collar 15 and serve to engage with a selected pair of the grooves 21, 21'. Each device 22 is composed of two half-rings 23, 24 connected and pivoted at their upper ends to the collar 15 by a hinge joint 25 with a horizontal pivot axis. The half-rings 23, 24 can be brought together to engage in the selected groove 21, 21' and an easily-releasable connector serves to detachably secure the free ends 28 of the half-rings 23, 24 together. These connectors (not shown) can each take the form of a nut and bolt and more particularly a bolt pivotably connected to one half-ring 23, 24 and movable into a recesses of the other half-ring 24, 23 to receive its nut.

As can be appreciated from the foregoing the devices 22 permit the collar 15 to be selectively coupled to the members 18 at axially-offset positions defined by the grooves 21, 21'.

Figure 3:
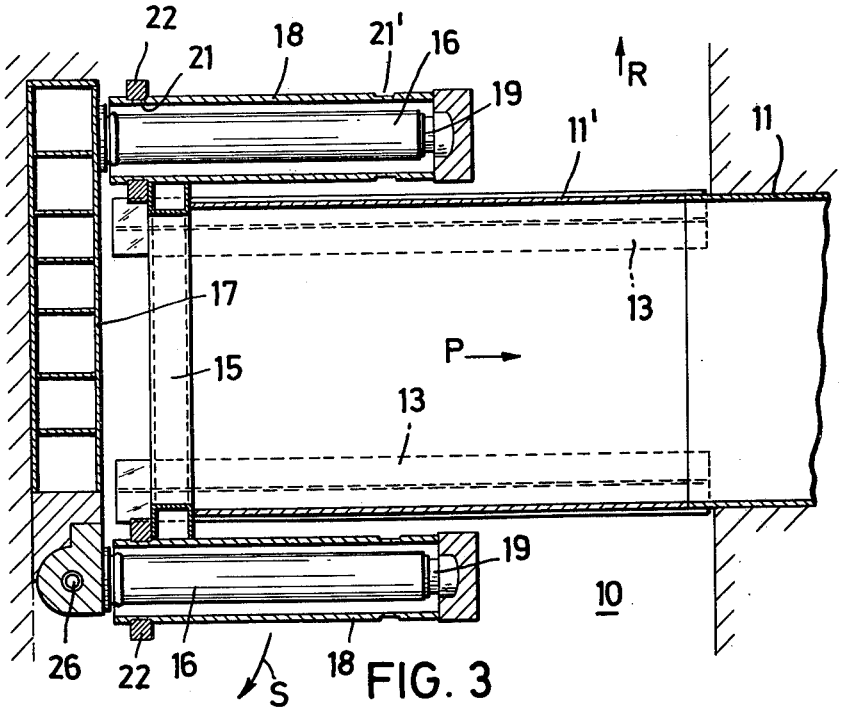
FIGS. 3 and 4 are diagrammatic part-sectional plan views of the apparatus shown in FIGS. 1 and 2 which depict the apparatus in different operating positions.

The operation of the apparatus will now be described with reference to FIGS. 3 and 4 where the last-installed pipe is designated 11 and the coaxially arranged next-to-be-installed pipe is designated 11'. As shown in FIG. 3, the rear end of the pipe 11' is contacted by the collar 15 and the clamping devices 22 are engaged in the rearmost grooves 21 of the members 18 and clamped or locked therein with the releasable connectors. The units 16 are then charged with pressure fluid to extend and their piston rods 19 urge the tension members 18 in the driving direction P. By virtue of the clamping devices 22 the collar 15 moves with the members 18 to urge the pipe 11' in the direction P. Thus also forcing the other pipe 11 or pipes 11 further into the ground. The full stroke of the units 16 preferably corresponds to at least half the length of the pipe 11' and when the units 16 have been fully extended the devices 22 are released from the grooves 21 and the units 16 are retracted to bring the members 18 back to their initial position.

Figure 4:
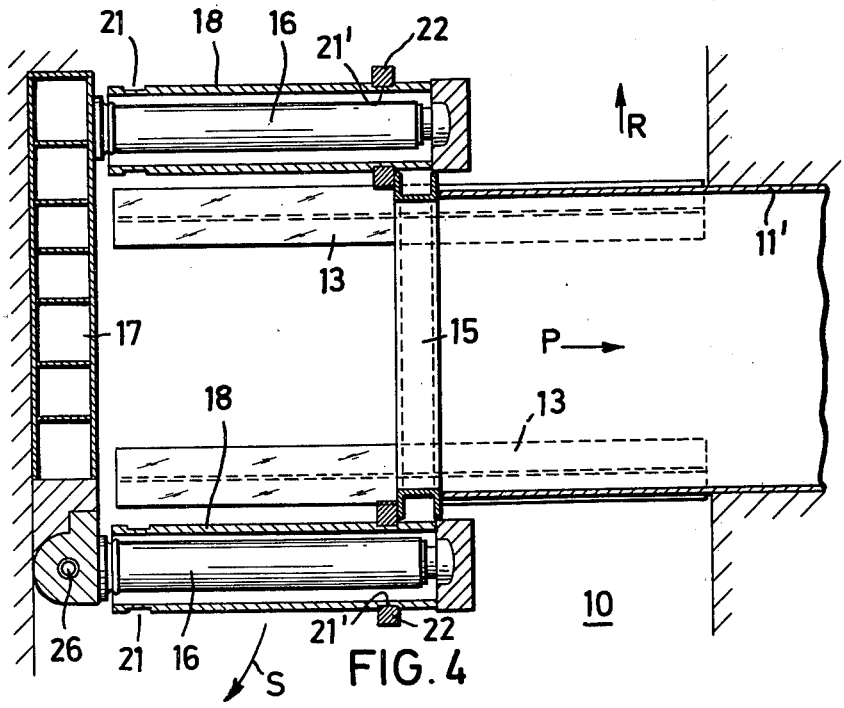

The collar 15 remains in the forward position and the associated devices 22 are now located in the forward grooves 21' of the members 18, as shown in FIG. 4, and re-secured. The units 16 are then extended once again and the collar 15 again urges the pipe 11' in the direction P. The pipe 11' is thus driven in by two operative cycles of the units 16. The devices 22 are released and the units 16 retracted ready to drive in the next pipe which can be installed from the side, i.e. longitudinally of the drift 10, by first swinging the pivotal unit 16 laterally outwards in the direction of arrow S. When the new pipe is located behind the previously-installed pipe the unit 16 can then be swung inwards into the position represented in FIG. 3, i.e. parallel to the pipes 11, 11' and the devices 22 coupled to the members 18.

It is possible to provide pivotal connections for both units 16 permitting both units 16 to swing outwards to allow the pipe to be introduced from either side as desired.

Although it is preferred for constructional simplicity to use two units 16 it is quite feasible to locate several units on each side of the apparatus and to provide additional devices 22 as appropriate.

In the context of the application mentioned above where the apparatus is used to form a roof structure for a tunnel the apparatus would be displaced in the direction of arrow R in FIGS. 3 and 4 when sufficient pipes have been driven in end-to-end at one location. The apparatus would then be operated again to drive a further series of pipes end-to-end. To facilitate displacement of the apparatus along the drift the abutment member 17 can be connected with the floor beams 13 to form a constructional support frame or unit which is bodily displaceable and may be guided if desired. Appropriate means can also be provided to adjust the height of the apparatus in the drift 10.

It is not essential to utilize cylinders or pipes as the tension members 18 and various other constructional forms can be adopted. Similarly the clamping devices 22 can take a variety of forms and need not engage in grooves on the members, 18.

We claim:

1. Tube driving apparatus having collar means engagable with one end of a pipe to be driven for transmitting force thereto, a plurality of piston and cylinder units for producing said force, and a plurality of separate tension members, each tension member being acted upon by a single piston and cylinder unit, the improvement comprising: clamping devices carried by said collar means, and location means on said tension members for receiving and locating said clamping devices at alternate positions displaced in the direction of driving said pipe.

2. The apparatus of claim 1 wherein each tension member at least partly surrounds one of the piston and cylinder units.

3. Apparatus according to claim 1, wherein the location means are grooves in the exterior of the tension members and the clamping devices are pairs of half rings pivotably mounted to the collar means and capable of being engaged in the grooves at one of said positions.

4. A tube-driving apparatus comprising force transmitting means engageable with one end of a pipe to be driven for transmitting force thereto, piston and cylinder units for producing said force, cylindrical tension members at least partly surrounding each of the piston and cylinder units, clamping devices carried by said force transmitting means, and location means on said tension members for receiving said clamping devices at positions displaced in the direction of driving said pipe.

5. The apparatus of claim 4 further comprising an abutment-forming means for supporting said piston and cylinder units, at least one of said units being pivotably connected to said abutment-forming means so as to be displaceable laterally to permit introduction of the pipe.

6. An apparatus according to claim 4, wherein the location means is in the form of grooves on the peripheral exterior of the tension members.

7. An apparatus according to claim 4, wherein the clamping devices are each in the form of a pair of half rings pivotably mounted to the force transmitting means and adapted to be releasably secured to the tension members at one of said positions.

8. An apparatus according to claim 4, and further comprising a displaceable support frame which at least includes floor beams for slidably supporting the force transmitting means.

9. An apparatus according to claim 4 and further comprising a displaceable support frame with floor beams for slidably supporting the force transmitting means and an abutment-forming means for supporting the units.

* * * * *